US008926482B2

(12) United States Patent
Miller, Jr.

(10) Patent No.: US 8,926,482 B2
(45) **Date of Patent: *Jan. 6, 2015**

(54) EXERCISE DEVICE

(71) Applicant: Gary Edward Miller, Jr., Staten Island, NY (US)

(72) Inventor: Gary Edward Miller, Jr., Staten Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/872,096

(22) Filed: Apr. 27, 2013

(65) Prior Publication Data

US 2013/0310234 A1 Nov. 21, 2013

Related U.S. Application Data

(63) Continuation-in-part of application No. 13/459,747, filed on Apr. 30, 2012, which is a continuation-in-part of application No. 29/391,361, filed on May 6, 2011, now Pat. No. Des. 669,545.

(51) Int. Cl.

| | |
|---|---|
| ***A63B 21/00*** | (2006.01) |
| ***A63B 22/00*** | (2006.01) |
| ***A63B 22/20*** | (2006.01) |
| ***A61H 15/00*** | (2006.01) |
| ***A63B 21/06*** | (2006.01) |
| ***A63B 21/072*** | (2006.01) |
| *A63B 23/12* | (2006.01) |

(52) U.S. Cl.

CPC ..... *A63B 21/00127* (2013.01); *A63B 21/1469* (2013.01); *A63B 21/1496* (2013.01); *A63B 22/20* (2013.01); *A61H 15/00* (2013.01); *A61H 15/0092* (2013.01); *A63B 21/0605* (2013.01); *A63B 21/072* (2013.01); *A63B 23/1236* (2013.01); *A63B 2208/0219* (2013.01); *A61H 2015/0014* (2013.01); *A61H 2201/1695* (2013.01); *A63B 2209/10* (2013.01); *A63B 2225/68* (2013.01)

USPC ..... 482/132; 482/141

(58) Field of Classification Search

USPC ..... 482/44, 49, 92, 93, 105, 106, 108, 109, 482/131, 132, 139, 141, 147; D21/662, 698

See application file for complete search history.

(56) References Cited

U.S. PATENT DOCUMENTS

| | | | |
|---|---|---|---|
| 2,104,927 | A | 1/1938 | Hussmann |
| D203,279 | S | 12/1965 | Spackman, Jr. et al. |
| 3,403,906 | A | 10/1968 | Burzenski |
| D221,874 | S | 9/1971 | Collins, Jr. et al. |
| D224,935 | S | 10/1972 | Winger |
| D248,114 | S | 6/1978 | Mangiapane |
| 4,351,525 | A | 9/1982 | Rozenblad |

(Continued)

*Primary Examiner* — Loan H Thanh
*Assistant Examiner* — Rae Rischer
(74) *Attorney, Agent, or Firm* — Thomas V. Ficchi

(57) ABSTRACT

The present invention relates to an exercise device that can function as a rolling exercise device. It comprises an elongate member that has a first handle assembly secured to its first end and a second handle assembly secured to its second end. The handle assemblies include a base that is rotatably secured to a handle support structure. The handle assemblies also include a handle for gripping. The handle assemblies further function as wheels on either side of the elongate member that allows the exercise device to roll. In addition, the handle assemblies can be removed from the ends of the elongate member and the assemblies can be mutually joined in a second configuration that does not include the elongate member. The second configuration can also be rolled along a surface by a user gripping the handles and applying a force that causes the base of each handle assembly to rotate.

18 Claims, 21 Drawing Sheets

(56) References Cited

U.S. PATENT DOCUMENTS

| | | | | |
|---|---|---|---|---|
| 4,768,778 | A | 9/1988 | Thomas, Jr. | |
| D306,886 | S | 3/1990 | Shiek et al. | |
| 5,358,463 | A | 10/1994 | Fuentes | |
| D357,952 | S * | 5/1995 | Chen | D21/684 |
| D358,856 | S * | 5/1995 | Boettger, Jr. | D21/684 |
| D370,704 | S | 6/1996 | Oberhoff | |
| D374,045 | S | 9/1996 | Ward, III | |
| 5,632,707 | A | 5/1997 | Daniel et al. | |
| D422,038 | S | 3/2000 | Iannetta | |
| D442,653 | S | 5/2001 | Panes | |
| D445,852 | S | 7/2001 | Mishan et al. | |
| D451,564 | S | 12/2001 | Dean | |
| D451,971 | S | 12/2001 | Mitchell | |
| D454,929 | S | 3/2002 | Huang | |
| D456,864 | S | 5/2002 | Dantolan | |
| D469,135 | S | 1/2003 | Bell | |
| 6,503,179 | B2 * | 1/2003 | Miraflor | 482/141 |
| D479,289 | S | 9/2003 | Turner | |
| D484,929 | S * | 1/2004 | Mollet | D21/662 |
| D497,961 | S | 11/2004 | Rolfes | |
| 6,837,837 | B2 * | 1/2005 | Nethery | 482/132 |
| D503,755 | S | 4/2005 | Schoening | |
| D506,514 | S | 6/2005 | Bernstein | |
| D520,576 | S | 5/2006 | Sonnon et al. | |
| D523,493 | S | 6/2006 | Horton | |
| 7,108,646 | B1 | 9/2006 | Quick | |
| D544,554 | S | 6/2007 | Brun | |
| D546,402 | S | 7/2007 | Sonnier | |
| D562,918 | S | 2/2008 | Tuller et al. | |
| D571,871 | S | 6/2008 | Backstrand et al. | |
| D576,693 | S | 9/2008 | Khubani | |
| D579,503 | S | 10/2008 | Hauser et al. | |
| D579,990 | S | 11/2008 | Dalcourt | |
| 7,468,025 | B2 | 12/2008 | Hauser et al. | |
| D584,093 | S | 1/2009 | Drumm | |
| D585,947 | S | 2/2009 | Royster | |
| D591,803 | S | 5/2009 | Carbone | |
| D593,168 | S | 5/2009 | Khubani | |
| 7,553,267 | B1 | 6/2009 | Hauser et al. | |
| D597,153 | S | 7/2009 | Friedman et al. | |
| D599,417 | S | 9/2009 | Friedman et al. | |
| D601,643 | S | 10/2009 | Byle | |
| 7,674,213 | B1 | 3/2010 | Christian | |
| D615,605 | S | 5/2010 | Frasco et al. | |
| D631,106 | S | 1/2011 | Zemel | |
| 7,935,039 | B2 * | 5/2011 | Dannenberg | 482/141 |
| D651,669 | S | 1/2012 | Garland et al. | |
| D669,545 | S * | 10/2012 | Miller, Jr. | D21/662 |
| 2006/0014615 | A1 * | 1/2006 | Godbold | 482/141 |
| 2012/0065557 | A1 | 3/2012 | Phillips | |
| 2013/0123078 | A1 * | 5/2013 | Marji | 482/139 |

* cited by examiner

EXERCISE DEVICE

This application is a continuation-in-part of U.S. application Ser. No. 13/459,747, filed Apr. 30, 2012, which is a continuation-in-part of U.S. application Ser. No. 29/391,361, filed May 6, 2011, which is now U.S. Design Pat. No. D669, 545, the disclosures of which are hereby incorporated by reference.

FIELD OF THE INVENTION

The present invention relates to an exercise device that may be used in a variety of configurations to allow a user to perform a variety of training, stretching, and muscle massaging exercises.

BACKGROUND OF THE INVENTION

Obesity has been and continues to be a major concern in modern day society. The number of physically inactive adults and children has reached alarming levels even though it is known that regular physical activity reduces the risk of dying prematurely from cardiovascular disease. In addition, regular physical activity also helps prevent the development of diabetes, maintain weight loss, and reduce hypertension. It has been estimated that only about 22 percent of Americans maintain the recommended amount of physical activity, which includes getting at least 150 minutes per week of moderate physical activity, such as taking a brisk walk.

It can be inferred from the foregoing that many people are not informed on how to properly train, which includes warming up the muscles before and cooling the muscles down after a workout. As a result, there is a need for an exercise device that allows a person to properly undergo physical activity by allowing a person to warm up, train, and then cool down after a training session. Examples of some exercise devices that have attempted to alleviate and address the foregoing problems are discussed below.

U.S. Pat. No. 7,108,646 to Quick relates to an infant roll cushion that includes a substantially rigid core element in the form of a hollow pipe. A soft resilient material surrounds the core element to form a curved outer surface so that the core element may be rolled on the floor by an infant. The infant roll cushion also includes end caps that cover the first and second end openings.

U.S. Pat. No. 6,837,837 to Nethery discloses an exercise device having a pair of opposing axially aligned elongated members that each have a first and second end. The exercise device also includes first and second wheels that are rotatably connected to each of the first ends of the pair of axially aligned elongated members. A connecting bar has each of its ends connected to the second end of each of elongated member to allow the distance between the elongated members to be varied.

Burzenski, U.S. Pat. No. 3,403,906, teaches a device comprising a roller that is mounted on a shaft where the shaft has gripping members on its opposite ends so that when a force is applied to the gripping members and the roller contacts a surface, the device can be moved along the surface by the roller being rolled.

None of the foregoing devices, however, disclose an exercise device that allows a user to warm up, train, and then cool down as in the present invention. Such a device will be described in the following disclosure.

OBJECTS OF THE INVENTION

It is an object of the invention to provide an exercise device that allows a person to perform exercises that warm up a user's body, that train a user's body, and that cool down a user's body after the user has undergone one or more training exercises.

It is another object of the invention to provide an exercise device that is convenient and easy to use for a variety of training exercises.

It is a further object of the invention to provide an exercise device that has different configurations to allow different exercises to be performed.

It is an even further object of the invention to provide an exercise device that allows a user to store personal, training, and other items therein.

SUMMARY OF THE INVENTION

The present invention relates to an exercise device that has multiple configurations to allow a user to perform a variety of exercises. The exercise device is generally comprised of an elongate member that has a first end and an axially aligned opposing second end wherein the first end is adapted to detachably connect to a base of a first handle assembly and wherein the second end is adapted to detachably connect to a base of a second handle assembly. Each handle assembly further includes a handle support structure that is rotatably connected to each base. The rotatable feature allows the first and second handle assemblies to function as wheels on either end of the elongate member to allow the exercise device to roll along a surface. The handle support structure of the first and second handle assemblies further include a handle to be gripped by a user.

The base of each handle assembly includes at least one sidewall extending from the one or more edges of each base. The sidewall of the base extends to a distance that covers at least a portion of at least one sidewall extending from the one Or more edges of each handle support structure. When the handle assemblies are connected at the respective ends of the elongate member, the exterior surface of either base's one or more sidewalls contacts the surface that the exercise device is to be rolled upon. In this way, a user can grip both handles and roll the exercise device along a surface, such as the ground. The sidewall of either base contacts the surface to be rolled upon and forces the base and, as a result, the elongate member to rotate while the handles remain in a substantially fixed position as they are gripped by a user. This allows the exercise device to function as a roller to exercise the abdominal muscles. In addition, the rolling feature of the exercise device also allows a user to perform other exercises, such as a variety of stretching and massage exercises as well as other exercises that are currently known and that use a rolling device.

The exercise device of the present invention is also designed so that the first and second handle assemblies can detach from either end of the elongate member and be mutually joined in a configuration that does not include the elongate member. In this configuration, the modified device still functions as a roller with the difference being a shorter distance between the first and second handle assembly since the elongate member is no longer present. The handles also remain in a substantially fixed position in this configuration when gripped by user while the bases of the first and second handle assemblies combine to function as a wheel to roll the device when the appropriate force is applied by the user.

In a method of using either configuration of the present invention, the handles of the first and second handle assemblies may be gripped and a pushing force or pulling three applied thereto to roll the device along a surface.

DETAILED DESCRIPTION OF THE INVENTION

Figure 1:
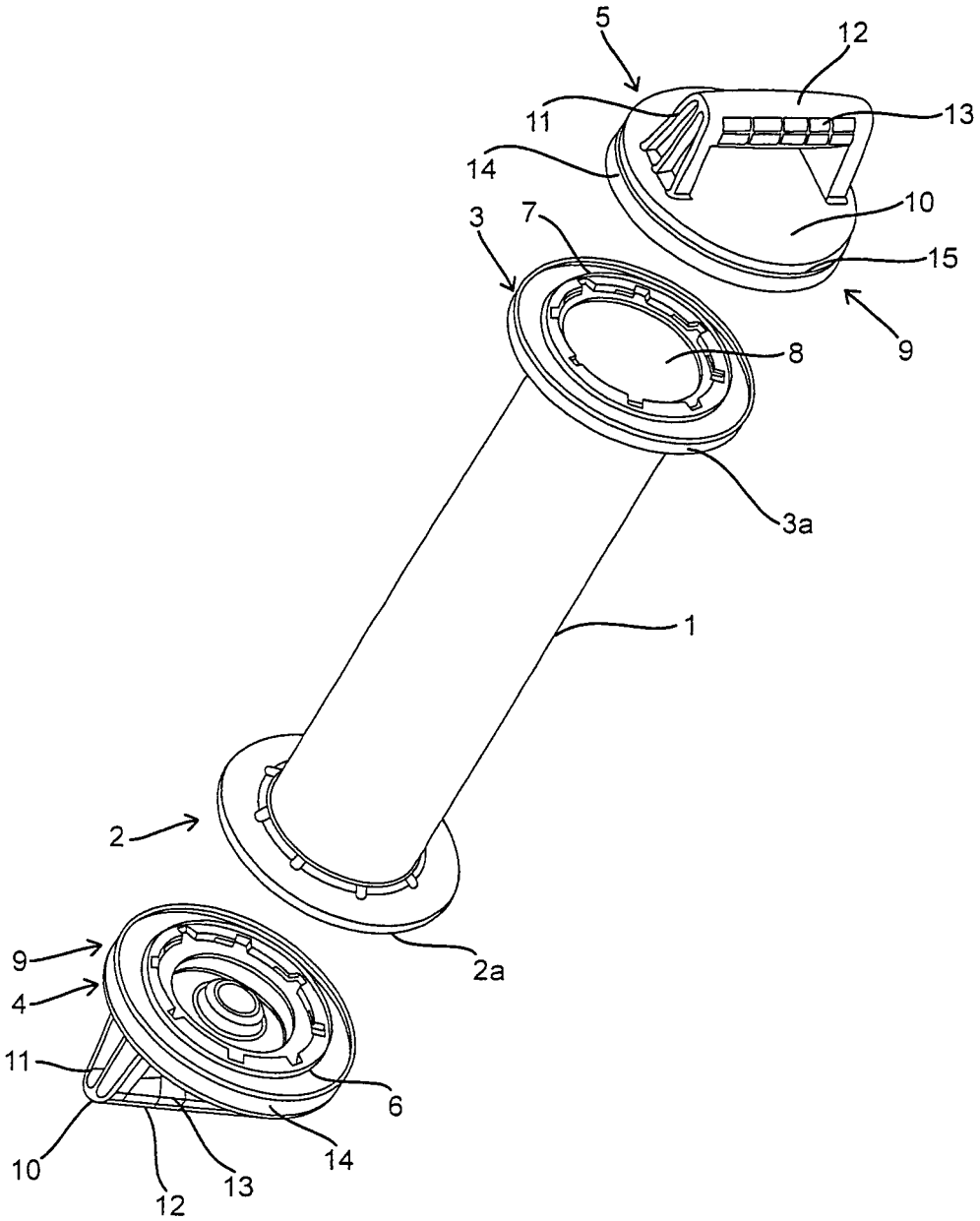
FIG. 1 is a perspective view of an embodiment of the exercise device of the present invention that includes the elongate member.

FIG. 1 shows a perspective view of an embodiment of the exercise device which includes a tubular elongate member 1 that has a first end attachment 2 and a second end attachment 3. The first and second end attachments 2 and 3 are adapted to connect to a first handle assembly 4 and a second handle assembly 5, respectively. The first handle assembly 4 has a plurality of female receptacles 6 on a first side surface of its base 9 that mate with a plurality of male protrusions located on a first side surface of the tube's first end attachment 2. The male protrusions on the first end attachment 2 are not shown in FIG. 1. The connection at the second end of the tube 2 is by a plurality of female receptacles 7 located on the first side surface of the second end attachment 3 that mate with a plurality of male protrusions that are located on the first side surface of the base of the second handle assembly 5. The male protrusions on the base of the second handle assembly 5 are not shown in FIG. 1. It is to be noted that in alternate embodiments, the first end attachment may have female receptacles that mate with male protrusions on the first handle assembly and the second end attachment may have male protrusions that mate with female receptacles on the second handle assembly.

The tubular elongate member is also preferably hollow as shown in FIG. 1. An opening 8 in the tube at the tube's second end is shown. There is also an opening at the tube's first end which is not shown in FIG. 1 but in other embodiments only one end may have an opening. Training and personal items can be stored in the hollow core of the tube, such as a jump rope, a resistance band, a water bottle etc. When items are placed in the tube's hollow core, the handle assemblies, when connected to either end of the tube, function as a cover to keep the items secured therein. In addition, one or more water bladders and/or weights and/or other weighted items can be removably or non-removably attached inside of the tube's hollow core along at least a portion of the surface of the wall that forms that hollow core. The weights increase the difficulty of the exercises performed by requiring a greater force to be exerted to roll the exercise device. The amount of water in the water bladder may be adjusted by removing or adding water to the bladder in order to increase or decrease the weight of the bladder. A cap or other similar mechanism may be used to seal and reseal the water bladder once a desired water weight has been reached. In addition, the weights may have an adjustable feature so that a desired weight setting may be used in the hollow core. The foregoing adjustable feature allows a user to gradually increase the difficulty level of the exercises performed so that an effective workout can be performed.

Figure 2:
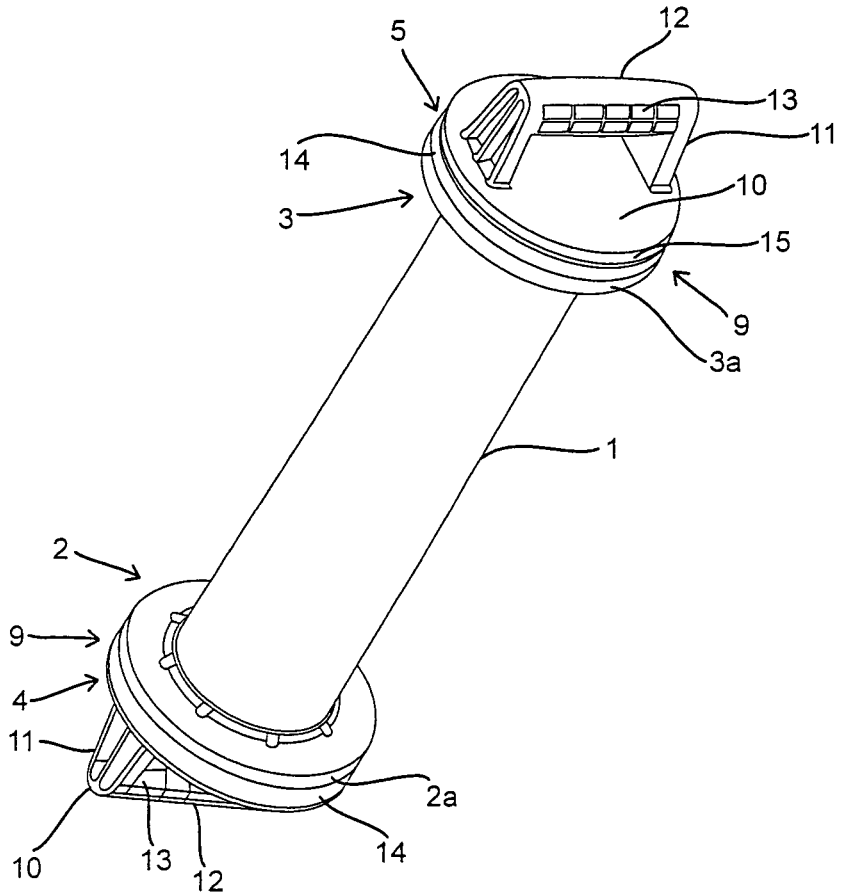
FIG. 2 is a view of the exercise device of FIG. 1 wherein the first and second handle assemblies are connected to the first and second end attachments respectively.

FIG. 2 shows a perspective view of the exercise device of FIG. 1 where the handle assemblies 4 and 5 are now connected to either end of the elongate member 1. The handle assemblies are comprised of a base 9 that is rotatably secured to a handle support structure 10 preferably by a bearing assembly. The handle support structure includes two preferably axially aligned handle support columns 11 extending perpendicularly from a first side of the handle support structure 10 to an upper portion wherein a handle 12 is secured to and extends between the upper portion of each support column 11. The handle 12 may preferably be equipped with a gripping aid 13 along its surface. The gripping aid 13 may be in the form of a plurality of depressions along the surface of the handle 12 as seen in FIGS. 1 and 2 or the gripping aid may alternatively be a rubber, tape, foam or other coating over at least a portion of the handle shaft that provides a gripping function.

The base 9 of the handle support assemblies includes a sidewall 14 extending from its edge. The base 9 has a slightly larger diameter than the handle support structure 10 so that the sidewall 14 of the base 9 extends over a portion of a sidewall 15 of the handle support structure to encase a portion therein. As a result of this orientation, the exterior surface of the sidewall 14 of the base is in contact with the surface that the exercise device will be rolled upon when each handle assembly is secured to the respective end of the elongate member. Due to the rotatable feature of each handle assembly 4 and 5, a user will grip either handle 12 and apply a force to roll the exercise device along a surface. The applied force by the user will cause the sidewalls 14 of the base to rotate along the surface that the device is in contact with. The rotation of the sidewalls will cause the exercise device to roll so that the base of the handle assemblies functions like a wheel at either end of the tubular elongate member. It is important to note that the handle support structure 10, including the support columns 11 and handle 12, will remain in a substantially fixed position while gripped by the user and while the device is in use rolling along a surface.

In addition, also seen from FIGS. 1-2 is a sidewall of the end attachment 2*a* and 3*a* that extends from the edge of each first and second end attachment 2 and 3. The top edge of the sidewalls 2*a* and 3*a* contact the top edge of the sidewalk 14 of the base when the first and second handle assemblies are attached to the first end and second end attachment, respectively. The exterior surface of the sidewalls of the first and second end attachment are also in contact with the surface that the device is rolled along. When the base rotates, it imparts its rotational force onto the end attachments which then causes the elongate member to also rotate.

The exterior surface of either base's sidewall and/or either end attachment's sidewall attachment may have a non-slip gripping material, such as but not limited to a rubber or foam material, to allow the sidewalls to better grip the surface that the device is rolled along. This coating may also prevent injuries that may otherwise occur if no coating was present because a sudden movement or slip by the exercise device on a surface will be less likely to occur. The non-slip gripping coating may be secured to the exterior surface of the sidewalls by a strong adhesive, such as an epoxy or other known strong adhesive. In other embodiments, however, it may be removably secured by removable means including velcro hook and loop fastening means, snap lock means, etc.

Figure 3:
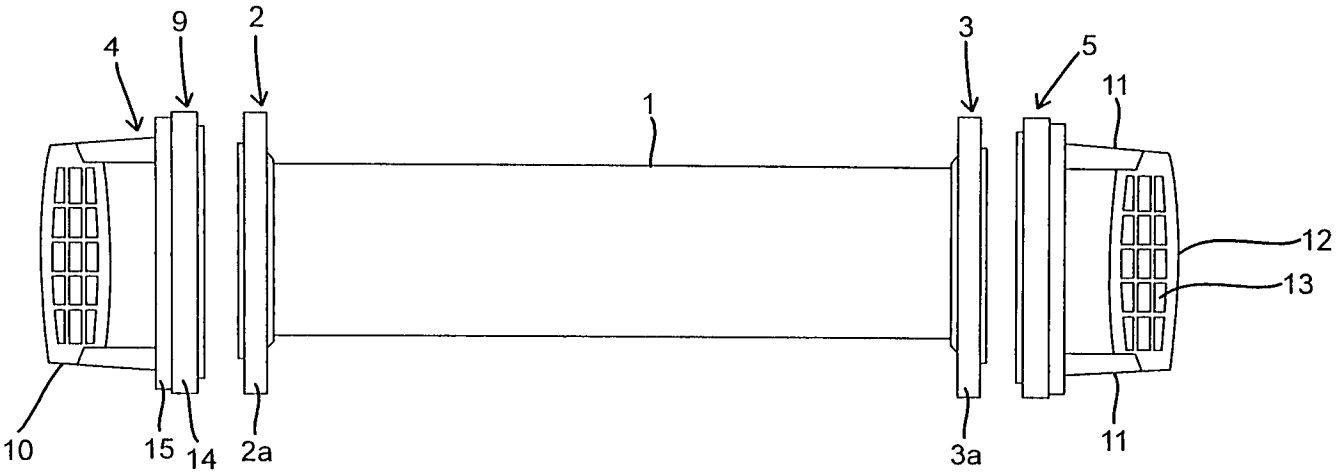
FIG. 3 is a front view of the exercise device of FIG. 1.
Figure 4:
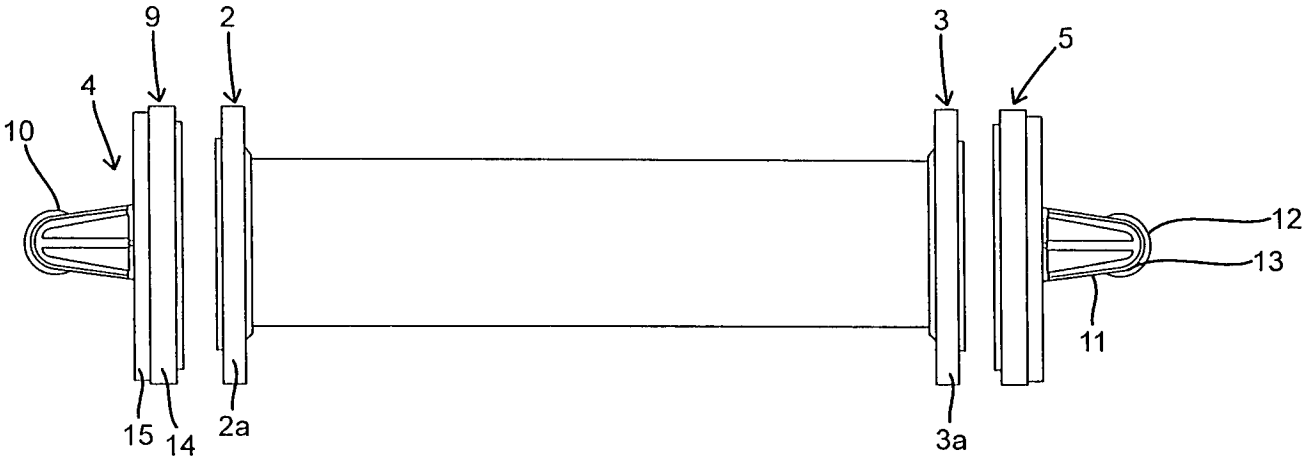
FIG. 4 is a top view of the exercise device of FIG. 1.

Referring to FIGS. 3 and 4 shown is a front and top view, respectively, of the exercise device of FIG. 1. Seen is the elongate member 1, the first end attachment 3 and second end attachment 3 secured to either end of the elongate member, and the first and second handle assemblies 4 and 5 detached from the first and second end attachments 2 and 3, respectively. The handle assemblies' base 9 and the sidewall 14 of either base are represented in FIGS. 3 and 4. Similarly, the handle assemblies' handle support structure 10, including the sidewall 15, handle support columns 11, and handle 12 with gripping aid 13 is also depicted. Important to note in FIGS. 3 and 4 is the position of either base's sidewall 14 over a portion of the sidewall 15 of either handle support structure. This is important because it illustrates that the point of contact between the exercise device and the surface to roll the device along is the exterior surface of either base's sidewall 14.

Figure 5:
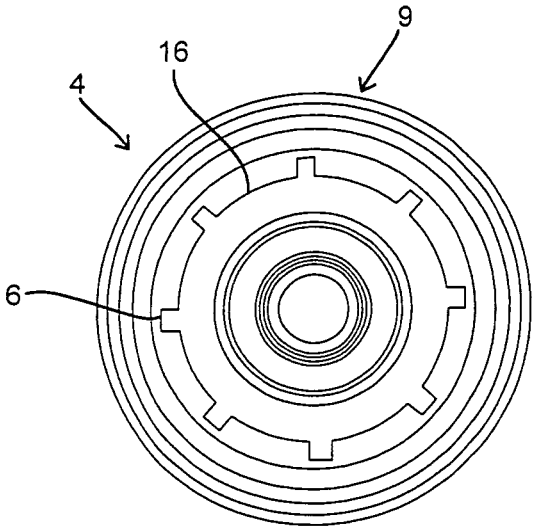
FIG. 5 is an elevational view of the first side of the base of the first handle assembly of FIG. 1.
Figure 6:
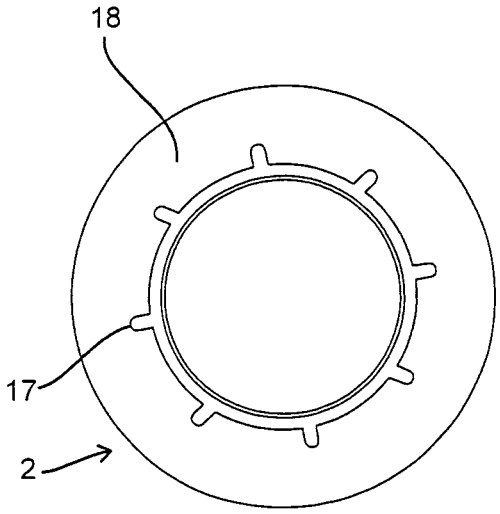
FIG. 6 is an elevational view of the first side of the first end attachment of FIG. 1.

FIG. 5 shows a view of a first side 16 of the base 9 of the first handle assembly 4 that mates with a first side 18 of the first end attachment 2. As discussed above and as shown by FIG. 5, the first side 16 of the base 9 has a plurality of female receptacles 6 that are designed to mate with a plurality of corresponding male protrusions 17 that are located on the first side 18 of the first end attachment 2, of which a view is shown in FIG. 6.

Figure 7:
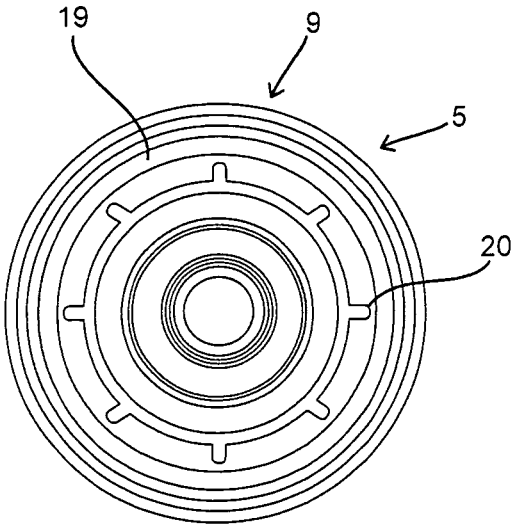
FIG. 7 is an elevational view of the first side of the base of the second handle assembly of FIG. 1.
Figure 8:
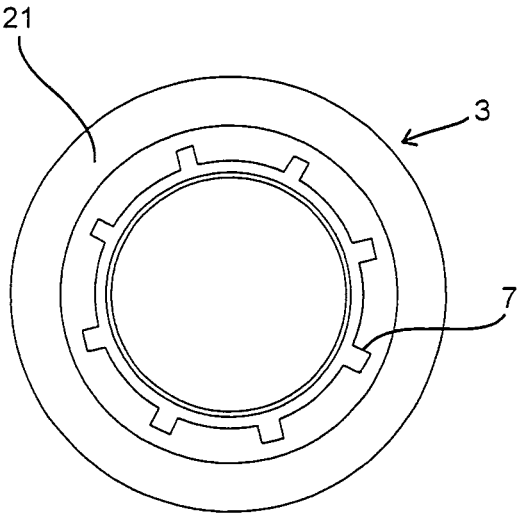
FIG. 8 is an elevational view of the first side of the second end attachment of FIG. 1.

Looking now to FIG. 7, the first side 19 of the base 9 of the second handle assembly 5 is shown. The base's first side has a plurality of male protrusions 20 that are designed to mate with plurality of corresponding female receptacles 7 located on the first side 21 of the second end attachment. The plurality of female receptacles 7 on the second end attachment are shown in FIG. 8.

Figure 9:
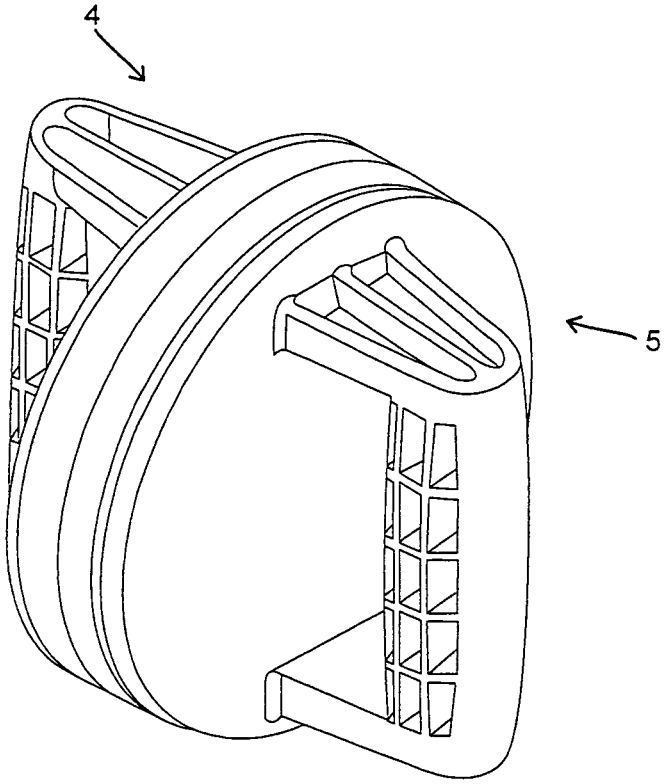
FIG. 9 is a perspective view of the exercise device of FIG. 1 wherein the first handle assembly and the second handle assembly are mutually joined in a configuration that does not include the elongate member.

The female receptacles on the first side of the base of the first handle assembly and the male protrusions on the first side of the base of the second handle assembly are also designed to be joinable such that an exercise device configuration that does not include the tube but that does include the two handles mutually joined can be assembled. This configuration is shown in FIG. 9 which is a perspective view of the two handle assemblies 4 and 5 mutually joined. The exercise device functions as a roller in this configuration. The distance between the handle shafts 12 in this configuration is less than it would have otherwise been if the elongate member was present between the first and second handle assemblies. The shorter distance between the handle shafts results in an exercise with a higher difficulty level since the load of a user is now distributed over a much shorter distance than if the elongate member had been present.

The exercise device in the configuration of FIG. 9 still rolls along a surface by the rotation of the sidewalls of the base of each handle assembly. The base of the handle assembly, as discussed earlier herein, is larger in diameter than the handle support structure of each handle assembly. This results in the sidewall of the base encasing a portion of the sidewall of the handle support structure such that each base's sidewall is the point of contact with the surface to be rolled upon. In operation, a user will grip both handle shafts and apply a force to cause the exercise device to roll along a surface. The handle support structure, including the handle support columns, and handle, will remain stationary as the exercise device is rolled while the base of each handle assembly rotates to allow the exercise device to roll.

As is seen from the Figures, the first and second end attachments and the base and handle support structure of each handle assembly are circular to allow for easy and convenient rolling of the exercise device along a surface. In addition, the elongate member is depicted as a tube but it may assume different shapes in other embodiments, such as but not limited to ovular, rectangular, square, etc.

The handle support structure, handle support columns, and handle shaft of each handle assembly are preferably a single unitary structure, meaning that they are not separate components that are secured together. However, in alternate embodiments, one or more of the handle support structure, handle support columns and handle shaft can be separate components that are secured together by screws or other means that are used in the relevant art.

The first and second end attachments are preferably independent pieces that are attached to the elongate member by an epoxy adhesive or other adhesive used in the relevant art. Rather than an adhesive, however, the first and second end attachments may be secured to either end of the elongate member by a set of screws or other equivalent attaching means. In an even further embodiment, the first and/or second end attachment may be a single unitary structure that extends from the respective end of the elongate member.

The exercise device, which includes the elongate member, the first and second end attachments, the base of the first and second handle assembly, the handle support structure, the handle support columns, and the handle shaft, may be made of high impact thermoplastic blends such as Cycoloy® polycarbonate/acrylonitrile-butadiene-styrene (PC/ABS). However other thermoplastics or heavy gauge impact plastics may be used that have qualities similar to PC/ABS.

The exercise device is preferably formed by laser cutting but other manufacturing processes that are capable of producing the exercise device may be used. An example of such a manufacturing process is an injection molding process.

Figure 10A:
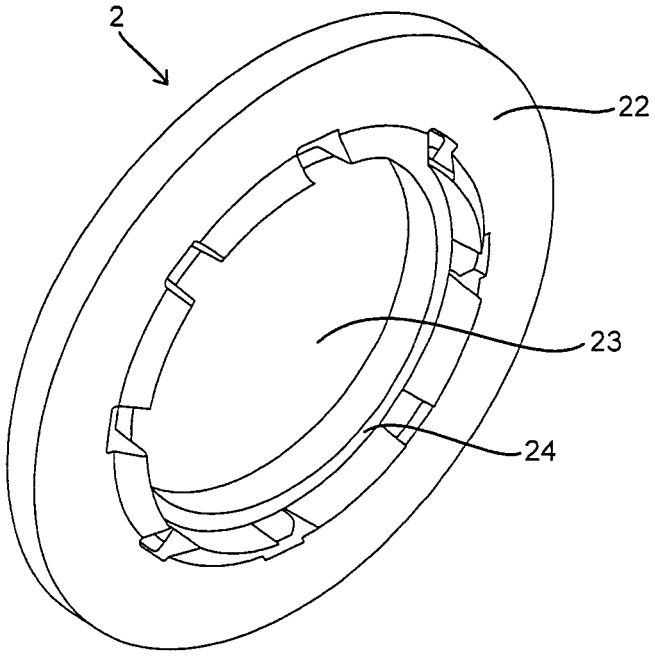
FIG. 10A is a perspective view of the second side of the first end attachment of FIG. 1.

FIG. 10A provides a perspective view of the second side 22 of the first end attachment 2. The second side contacts the tubular elongate member. As is seen from FIG. 10A, the first end attachment is circular and the second side has a central opening 23. The central opening 23 corresponds with the opening 8 in the tribe that was shown in FIG. 1 when the first end attachment is placed over the respective end of the tube. The central opening 23 also has a protruding rim 24 that contacts the edge of tube's end when the end is inserted into the central opening 23. The protruding rim 24 prevents the tube from extending through the central opening 23. Once the tube end is situated in the central opening, it can be secured therein by the means that have already been discussed herein.

Figure 10B:
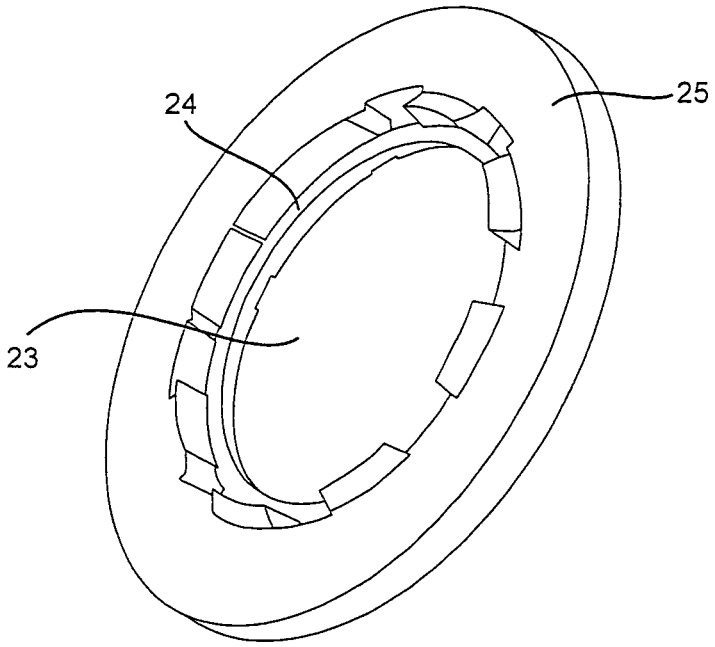
FIG. 10B is a perspective view of the second side of the second end attachment of FIG. 1.

FIG. 10B is a view of the second side 25 of the second end attachment 3. Like the first end attachment, the second side of the second end attachment contacts the respective end of the tubular member. The second side of the second end attachment also has a protruding rim 24 lining the central opening 23 to contact and prevent the respective tube end from extending through the central opening. Once the tube end is positioned in the second end attachment's central opening, it can be secured therein by means that have already been discussed.

Figure 10C:
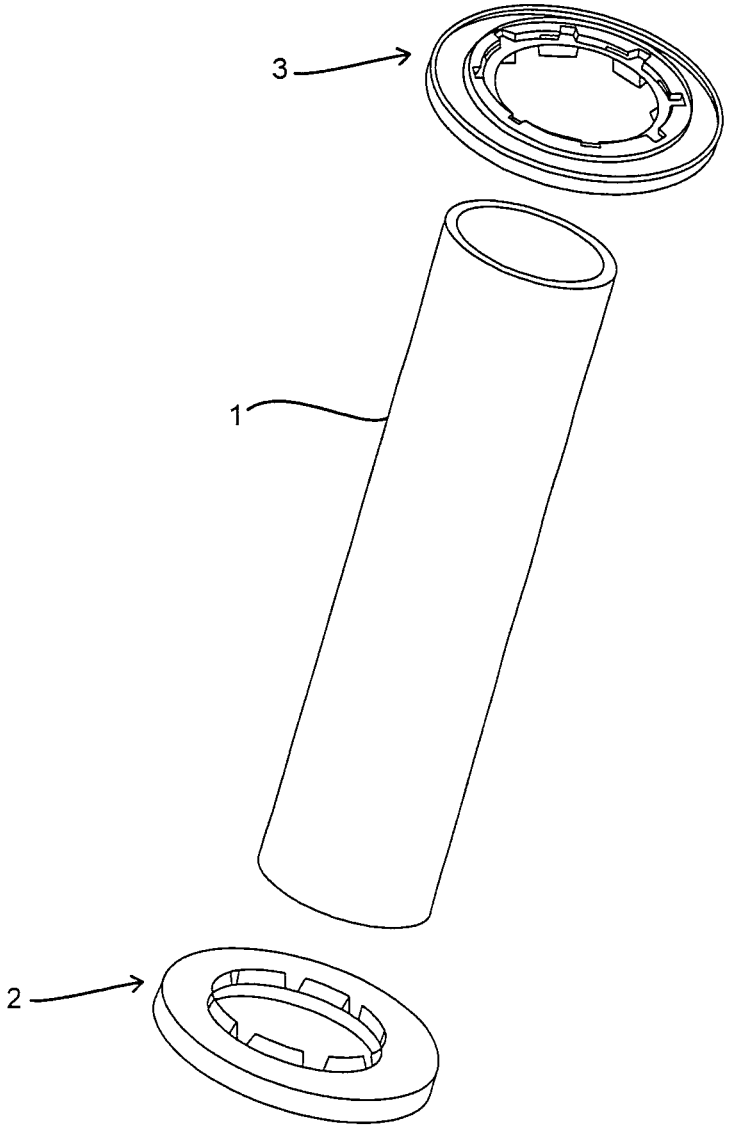
FIG. 10C is an exploded view of the tubular elongate member of FIG. 1, including the first end attachment and the second end attachment.

FIG. 10C shows an exploded view of the tubular elongate member 1, including the first end attachment 2 and the second end attachment 3. The end attachments are preferably separate items that may be permanently affixed to the respective ends of the tubular elongate member but in other embodiments may be removably affixed or the end attachments may be extensions of the tubular member such that a single unitary structure is formed. In the preferred embodiment, the end attachments may be permanently secured to the respective ends of the tubular elongate member by permanent attachments means as discussed herein which include but are not limited to an epoxy or other strong suitable adhesive. In addition, screws may also be used in addition to or rather than the foregoing permanent attachment means.

Figure 11A:
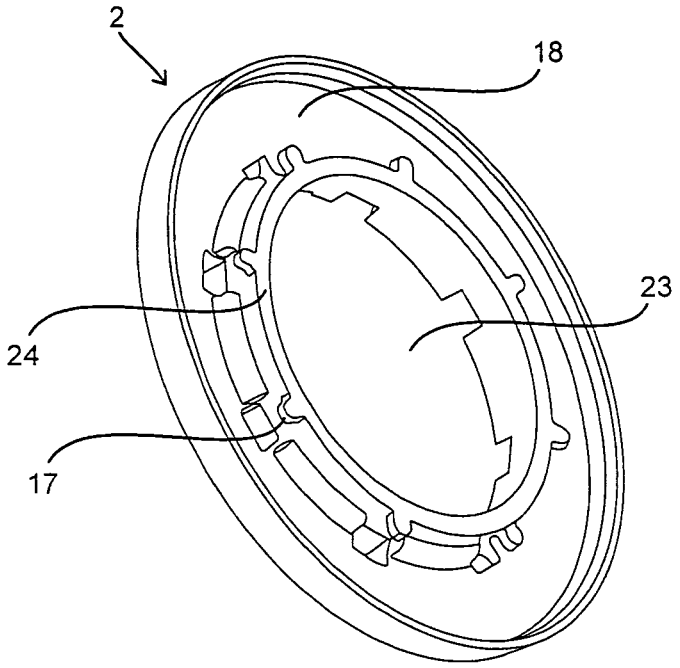
FIG. 11A is a perspective view of the first side of the first end attachment of FIG. 1.

With reference now to FIG. 11A, shown is a perspective view of the first side 18 of the first end attachment 2. The first side 18 mates with the first side 16 of the base 9 of the first handle assembly 4. This view gives a better indication of the features that are present on the first side. The first end attachment 2 is shown as a circular member that has a central opening 23 that is designed to correspond with the opening of the tube. The protruding rim 24 shown in FIG. 10A extends perpendicularly from the first side 18 of the first end attachment 2. The protruding rim 24 lines the central opening 23. A plurality of male protrusions 17 extend perpendicularly from the rim 24. The male protrusions 17 fit in corresponding female receptacles that are located on the first side of the base of the first handle assembly.

Figure 11B:
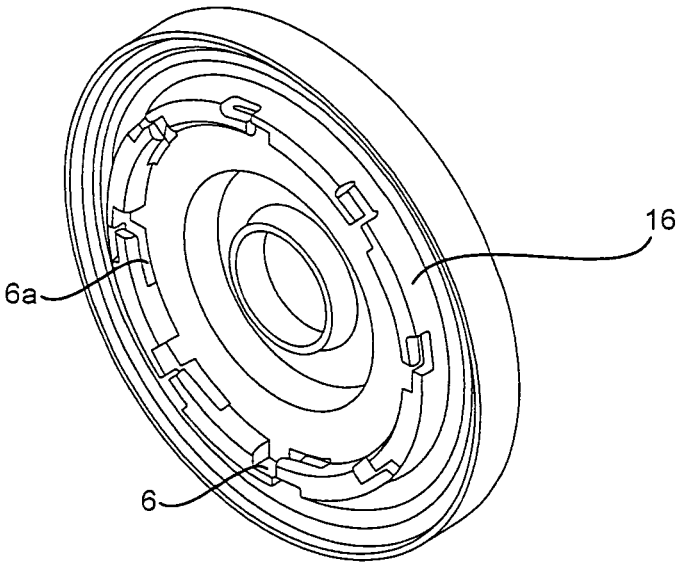
FIG. 11B is a perspective view of the first side of the base of the first handle assembly of FIG. 1.

FIG. 11B shows the first side 16 of the first handle assembly's base 9 that contacts and mates with the first side 18 of the tube's first end attachment 2. The base 9 has a plurality of female receptacles 6 on its surface to receive the plurality of male protrusions 17 on the first end attachment 2. In operation, the female receptacles are aligned with the male protrusions 17 on the first end attachment 2 and once inserted, the base 9 of the first handle assembly 4 or the tubular member may be rotated to three the mule protrusions to enter a tunnel portion 6*a* that is adjacent to each female receptacle, thereby locking the first handle assembly to the first end attachment.

Figure 12A:
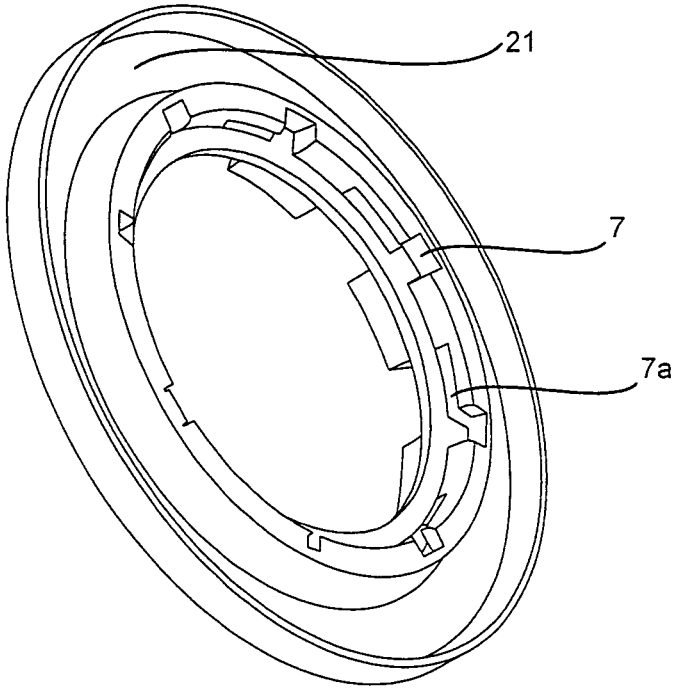
FIG. 12A is a perspective view of the first side of the second end attachment of FIG. 1.

FIG. 12A presents a view of the first side 21 of the second end attachment 3 that mates with the first side of the base 9 of the second handle assembly 5. Shown is the plurality of female receptacles 7 and a tunnel portion 7*a* located adjacent to each female receptacle 7. The wood portion, as described above in FIGS. 11A-11B, receives the complementary male piece from the second handle assembly after it has been inserted into the female receptacles to secure the second handle assembly to the second end attachment.

Figure 12B:
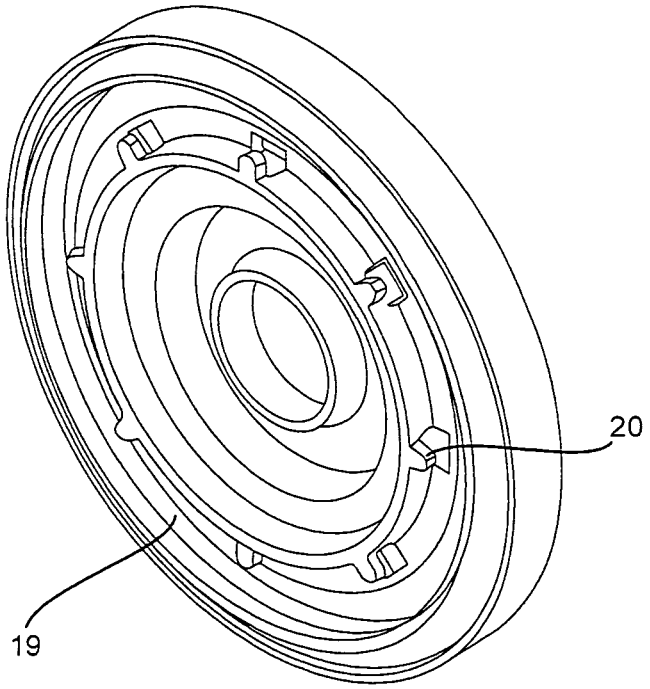
FIG. 12B is a perspective view of the first side of the base of the second handle assembly of FIG. 1.

FIG. 12B is a view of the first side 19 of the base of the second handle assembly. The base's first side mates with the first side of the second end attachment. The plurality of male protrusions 20 mates with the plurality of female receptacles 7 located on the first side 21 of the second end attachment 3. Once received by the female receptacles, the base or the tubular member may be rotated to force the male protrusions into the tunnel portion 7*a* that is adjacent to each female receptacle.

Figure 13A:
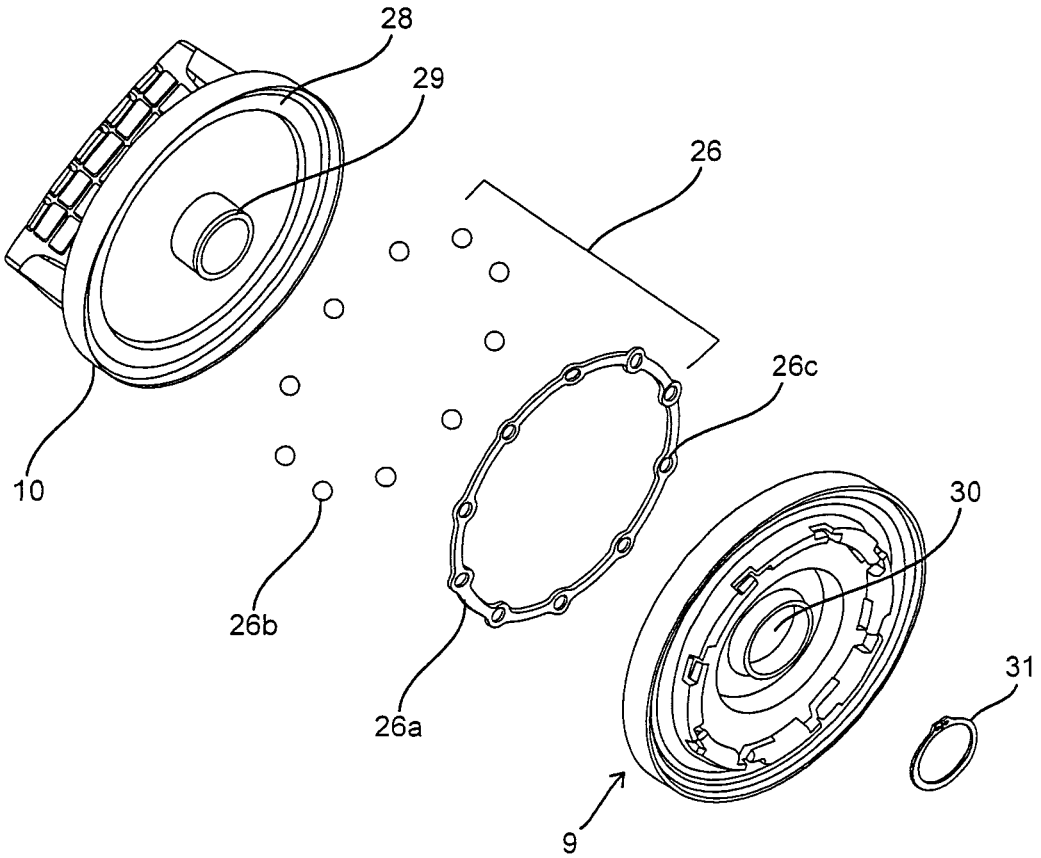
FIG. 13A is an exploded perspective view of the first handle assembly of FIG. 1.

FIG. 13A is an exploded view of the first handle assembly that illustrates its internal workings. It shows the handle support structure 10, the bearing assembly 26, and the base 9. The bearing assembly includes a race 26*a*, ball bearings 26*b*, and receptacles 26*c* in the race for receiving the ball bearings. The ball bearings are preferably steel but in different embodiments the ball bearings may be glass or other suitable materials. The race and ball bearings fit in a channel 27 (shown in FIGS. 13B, 13C, and 13E) on the second the side of the base that is aligned with a channel 28 on the second side of the handle support structure. The second side of the handle support structure also has a centrally located cylindrical extension 29 that extends through a centrally located orifice 30 in the base to connect the handle support structure to the base. A retaining ring 31 is secured around the end of the cylindrical extension 29 once the extension has passed through the base's orifice 30. The retaining ring 31 secures the handle support structure to the base.

Figure 13B:
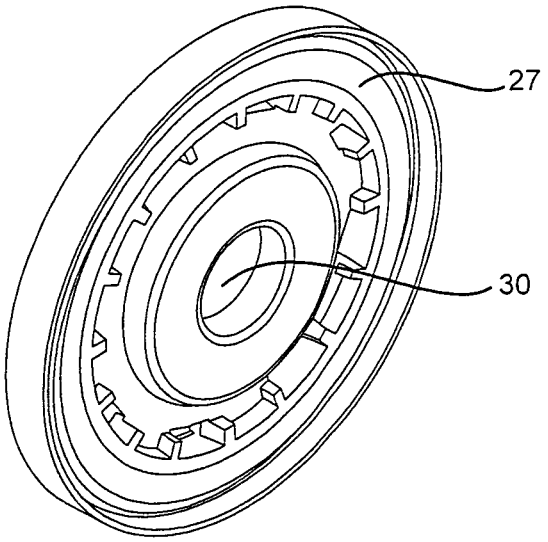
FIG. 13B is a perspective view of the second side of the base of the first handle assembly of FIG. 13A

FIG. 13B shows a view of the second side of the base of the first handle assembly. Illustrated in FIG. 13B is the channel 27 that the bearing assembly is located when the handle support structure and base are connected. Also visible is the orifice 30 that receives the cylindrical extension 29 of the handle support structure.

Figure 13C:
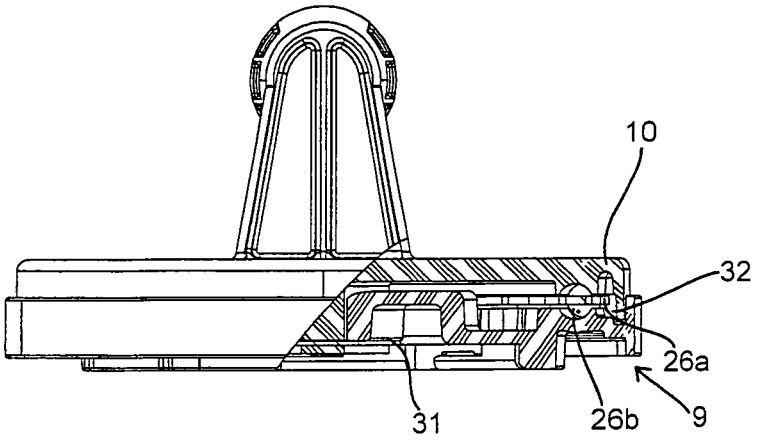
FIG. 13C is a side view of the first handle assembly of FIG. 13A that shows a portion of the internal workings of the handle assembly when the handle support structure is secured to the base.

FIG. 13C is a side view of the first handle assembly that shows a portion of the internal workings when the handle support structure 10 and base 9 are rotatably secured. Shown is the channel 32 that receives the race 26*a* and ball bearings 26*b* to allow for the rotation of the handle with respect to the base or the base with respect to the handle. The channel 32 for receiving the bearing assembly is formed by aligning the handle support structure's channel 28 with the base's channel 27 when the base 9 and handle support structure 10 are connected.

Figure 13D:
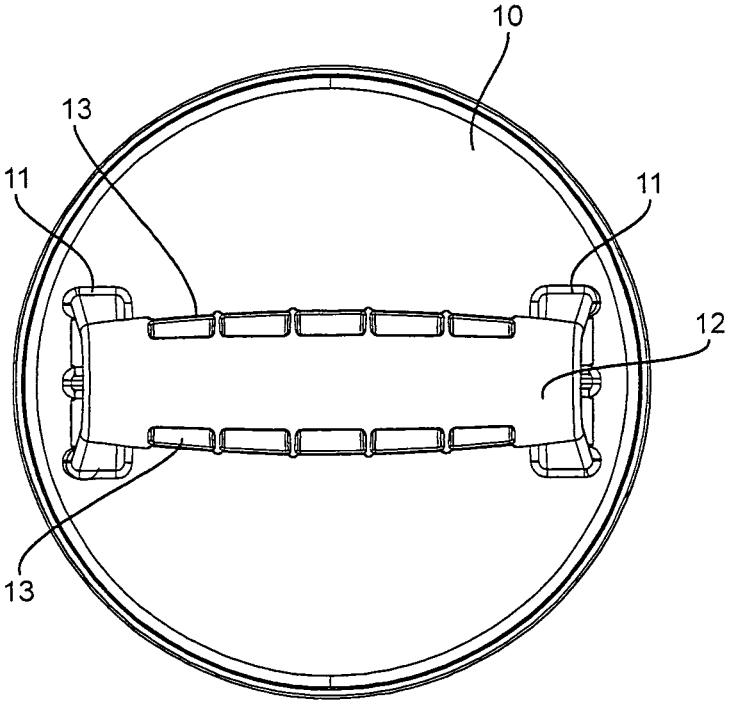
FIG. 13D is a top view or the first handle assembly of FIG. 13A.

FIG. 13D is a top view of the first handle assembly of FIG. 1. It shows the handle support structure 10, the handle support columns 11 extending therefrom, and the handle shaft 12 with gripping aids 13.

Figure 13E:
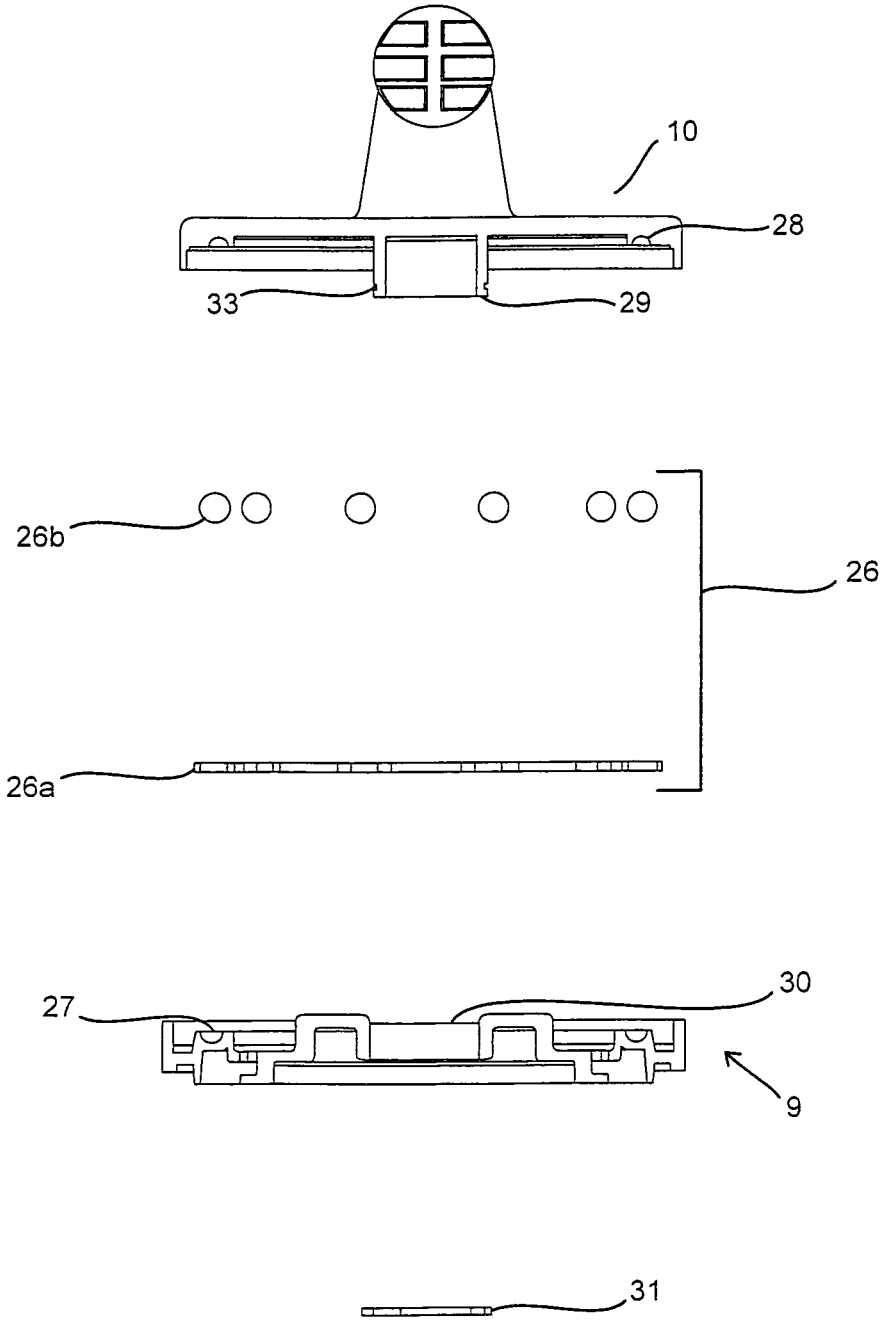
FIG. 13E is an exploded cross-sectional view of the first handle assembly of FIG. 13A.

FIG. 13E is an exploded vertical cross-sectional view of the first handle assembly shown in FIG. 13A. It shows the handle support structure 10 and the channel 28 on the handle support structure for receiving a portion of the bearing assembly 26. Also shown is the cylindrical extension 29 and an indentation 33 towards its bottom portion for receiving the retaining ring 31 once the cylindrical extension 29 has been inserted through the corresponding orifice 30 that is located on the base 9. Visible on the base 9 is the channel 27 that receives a portion of the bearing assembly 26. Also visible, as discussed, is the centrally located orifice 30 that receives the handle support structures cylindrical extension 29. Finally shown is the bearing assembly 26, which includes the race 26*a* and the ball bearings 26*b*. It is to be appreciated that there are preferably 10 ball bearings 26*b* as shown in FIG. 13A that are received by 10 receptacles 26*c* in the race 26*a*. In other embodiments, however, the bearing assembly may include more than or less than 10 ball bearings and corresponding holes in the bearing assembly's race.

Figure 14A:
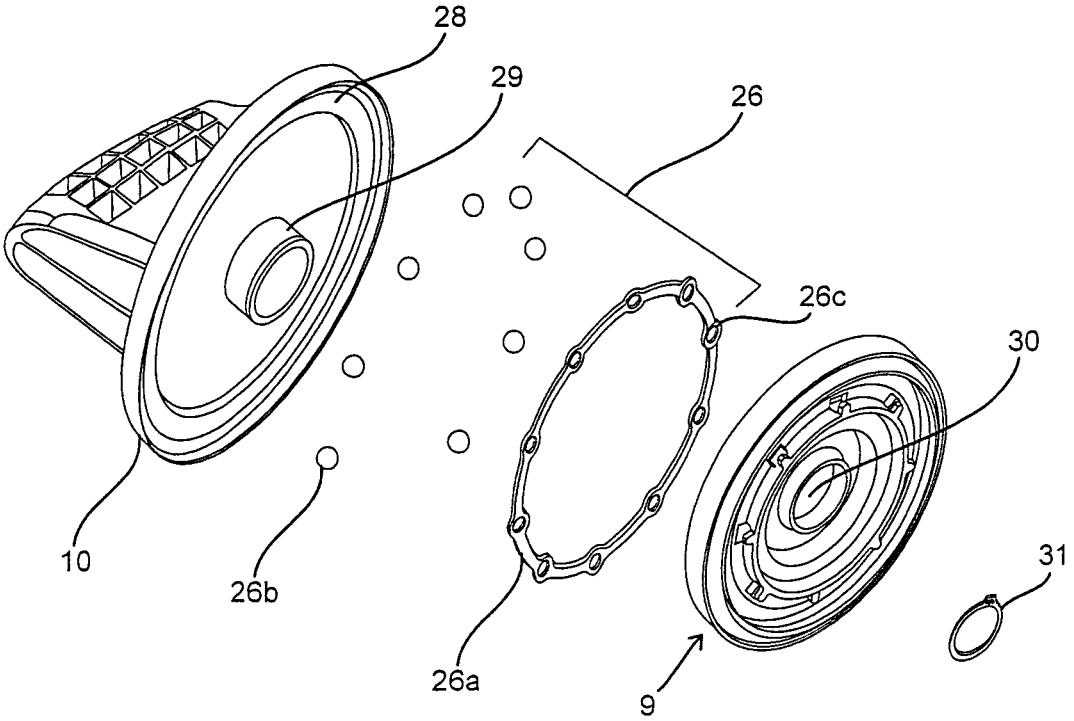
FIG. 14A is art exploded perspective view of the second handle assembly of FIG. 1.

FIG. 14A illustrates the internal workings of the second handle assembly. It contains the same components as those shown in FIG. 13A with respect to the first handle assembly. In particular, it contains a bearing assembly 26 that includes a race 26*a* and ball bearings 26*b*. The ball bearings used in the present invention are preferably steel but in different embodiments the ball bearings may be glass or other suitable materials. In addition the race is preferably a metal but in alternate embodiments it may be any other material used in the art. The race and ball bearings fit in a channel 27 (shown in FIGS. 14B, 14C, and 14E) on the second the side of the base that is aligned with a channel 25 on the second side of the handle support structure. The second side of the handle support structure also has a centrally located cylindrical extension 29 that extends through a centrally located orifice 30 in the base to connect the handle support structure to the base. A retaining ring 31 is secured around the end of the cylindrical extension 29 once the extension has passed through the base's orifice 30. The retaining ring 31 secures the handle support structure to the base and is preferably a metal but the retaining ring may be a strong plastic or other material that is strong enough to secure the handle support structure to the base of each handle assembly.

Figure 14B:
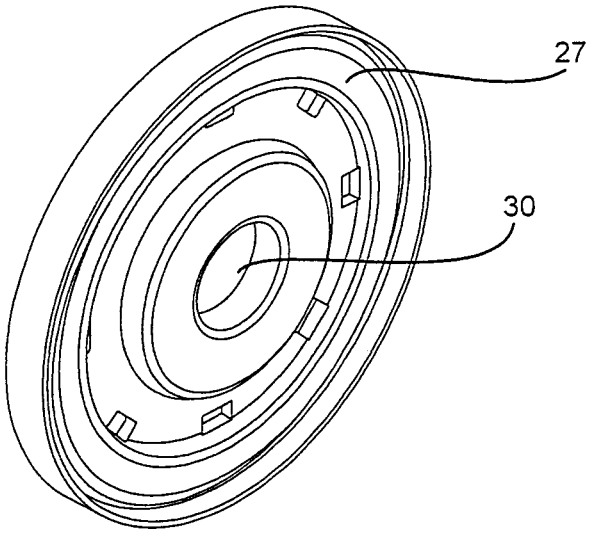
FIG. 14B is a perspective view of the second side of the base of the second handle assembly of FIG. 14A.

FIG. 14B shows the second side of the base of the second handle assembly. Shown is the channel 27 that the bearing assembly is located when the handle support structure and base are connected. Also visible is the orifice 30 that receives the cylindrical extension 29 of the handle support structure.

Figure 14C:
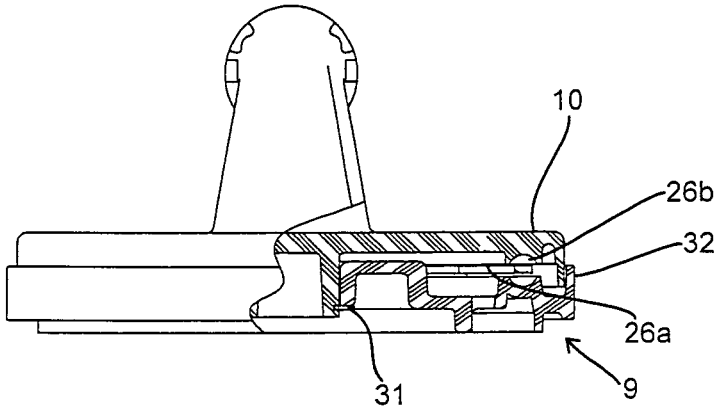
FIG. 14C is a side view of the second handle assembly of FIG. 14A that shows a portion of the internal workings of the handle assembly when the handle support structure is secured to the base.

FIG. 14C is a side view of the second handle assembly that shows a portion of the internal workings when the handle support structure 10 and base 9 are rotatably secured. Shown is the channel 32 that receives that race 26*a* and ball bearings 26*b* to allow for the rotation of the handle with respect to the base or the base with respect to the handle. The channel 32 for receiving the bearing assembly is formed by aligning the handle support structure's channel 28 with the base's channel 27 when the base 9 an handle support structure 10 are connected.

Figure 14D:
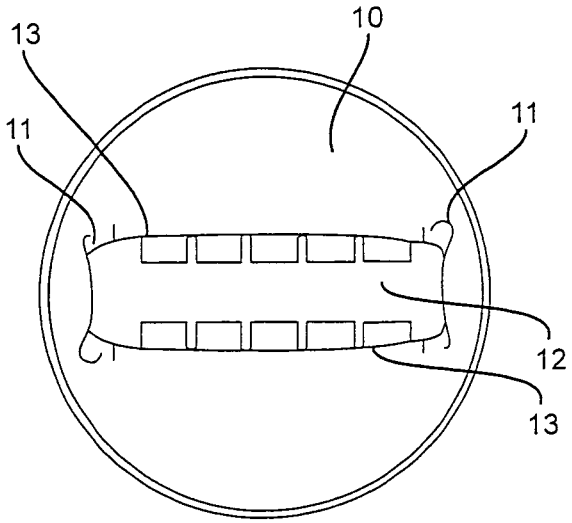
FIG. 14D is a top view of the second handle assembly of FIG. 14A.

FIG. 14D is a top view of the second handle assembly. It shows the handle support structure 10, the handle support columns 11 extending therefrom, and the handle shaft 12 with gripping aids 13.

Figure 14E:
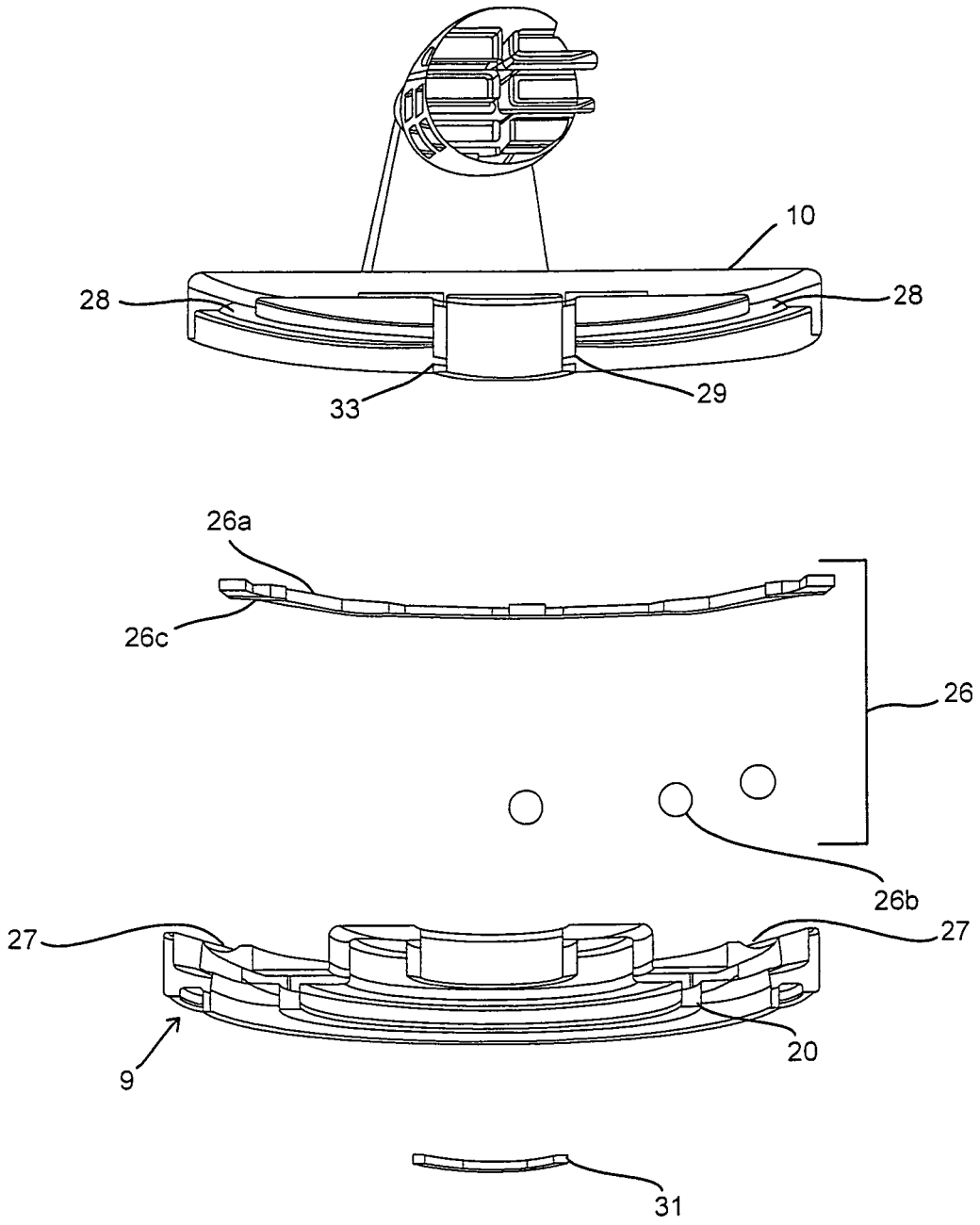
FIG. 14E is an exploded cross-sectional view of the second handle assembly of FIG. 14A.

FIG. 14E is an exploded vertical cross-sectional view of the second handle assembly shown in FIG. 14A. It shows the handle support structure 10 and the channel 28 on the handle support structure for receiving a portion of the bearing assembly 26. Also shown is the cylindrical extension 29 and an indentation 33 towards its bottom portion for receiving the retaining ring 31 once the cylindrical extension 29 has been inserted through the corresponding orifice 30 that is located on the base 9. Visible on the base 9 is the channel 27 that receives a portion of the bearing assembly 26. Also visible, as discussed, is the centrally located orifice 30 that receives the handle support structure's cylindrical extension 29. In addition, a portion of the male protrusions 20 on the first side 19 of the base 9 are shown. Finally shown in FIG. 14E is the bearing assembly 26, which includes the race 26*a* and the ball bearings 26*b*. It is to be appreciated that there are preferably 10 ball bearings 26*b* as shown in FIGS. 13A and 14A that are received by 10 receptacles 26*c* in the race 26*a*. In other embodiments, however, the bearing assembly may include more than or less than 10 ball bearings and corresponding holes in the bearing assembly's race.

It will be appreciated by those skilled in the art that bearing assemblies other than the bearing assembly illustrated in FIGS. 13A and 14A can be employed, such as but not limited to a lazy susan assembly. In addition, the first and second handle assemblies can be removed from the respective ends of the tubular elongate member and be used as pushup handles. In even further embodiments, at least a portion of the exterior surface of the elongate member may be coated in ethylene vinyl acetate (EVA) foam to make it softer for a user to lie on when performing a massage, stretching, or training exercise. Other materials that have characteristics similar to EVA foam, such as any other soft resilient material, and that are known in the relevant art may also be used as a coating. The coating preferably occupies a substantial portion of the exterior surface, but in other embodiments it may only occupy sections of the exterior surface that a user is anticipated to lie over. Even further, the sections of the coating may serve as a guide to a user of where to lie or rest a body part on the elongate member.

Figure 15:
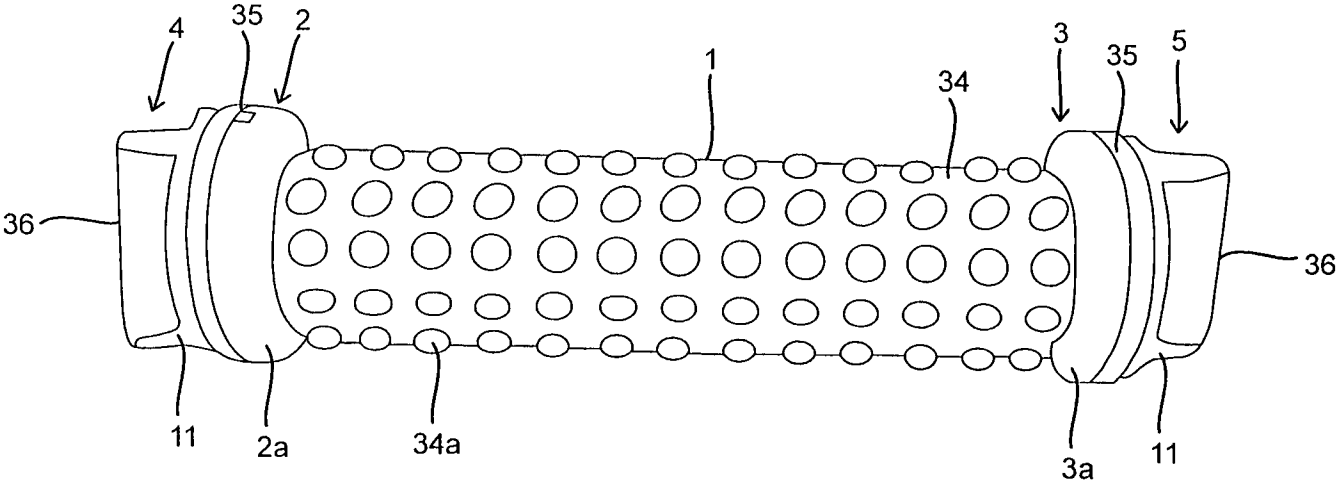
FIG. 15 is a top view of an embodiment of the exercise device that has a foam material surrounding the elongate member, a foam gripping aid surrounding the handles, and a rubber gripping surface surrounding the exterior surface of the sidewalls of the base of the first and second handle assemblies.

FIG. 15 depicts a top view of an embodiment of the exercise device that includes an EVA foam covering 34 surrounding the body portion of the elongate member 2. The foam covering has a plurality of bumps 34*a* along its surface. The plurality of bumps 34*a* is a massage aid that helps massage an area of the body that is resting thereon. In using the exercise device as a massager, a user may rest a portion of their body on a surface of the foam 34 and roll the exercise device by applying a force from their body to the surface on the elongate member in order to force the exercise device to roll in a desired direction. In addition, the embodiment of the exercise device illustrated in FIG. 15 also shows a rubber gripping surface 35 that coats the exterior surface of the sidewalls of the base of the handle assemblies and the exterior surface of the sidewalls of the end attachments. Also shown is a foam gripping surface 36 that surrounds the handles 12 of each handle assembly 4 and 5.

Figure 16:
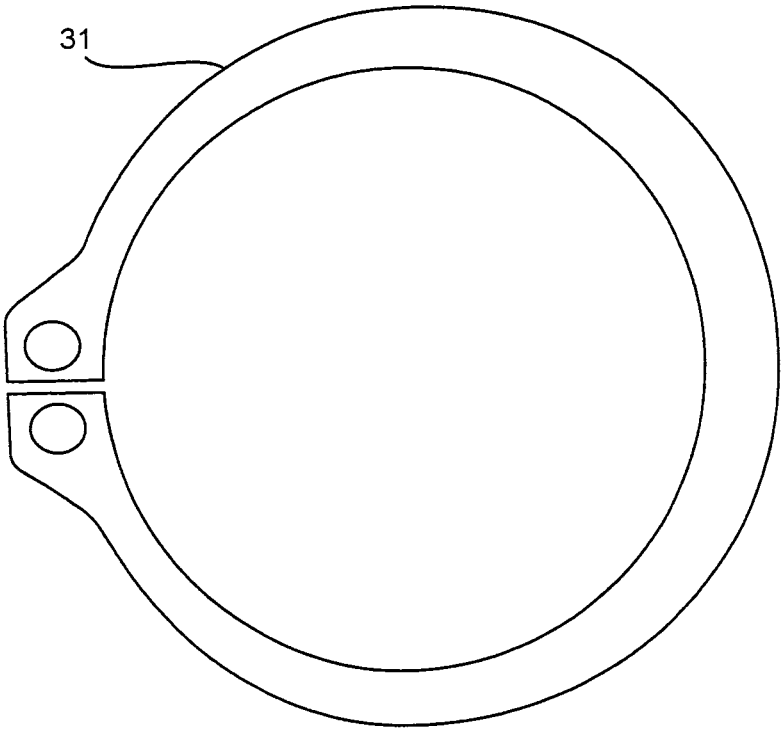
FIG. 16 is a top view of the retaining ring that is used to secure the base and handle support structure of the first and second handle assemblies.

FIG. 16 shows a top view of the retaining ring 31 used in the present invention for securing the handle support structure 10 to the base 9 of each handle assembly 4 and 5. As seen in FIG. 16, the retaining ring is preferably a tapered section retaining ring and it will be appreciated by those skilled in the art that other tapered retaining rings can be used rather than the retaining ring shown in FIG. 16. In addition, retaining rings other than tapered retaining rings may also be used in alternate embodiments. Further, a washer may be positioned between the retaining ring 31 and the orifice 30 in the base that the cylindrical extension projects through. The washer aids in the security and maneuverability of the handle assemblies.

Figure 17A:
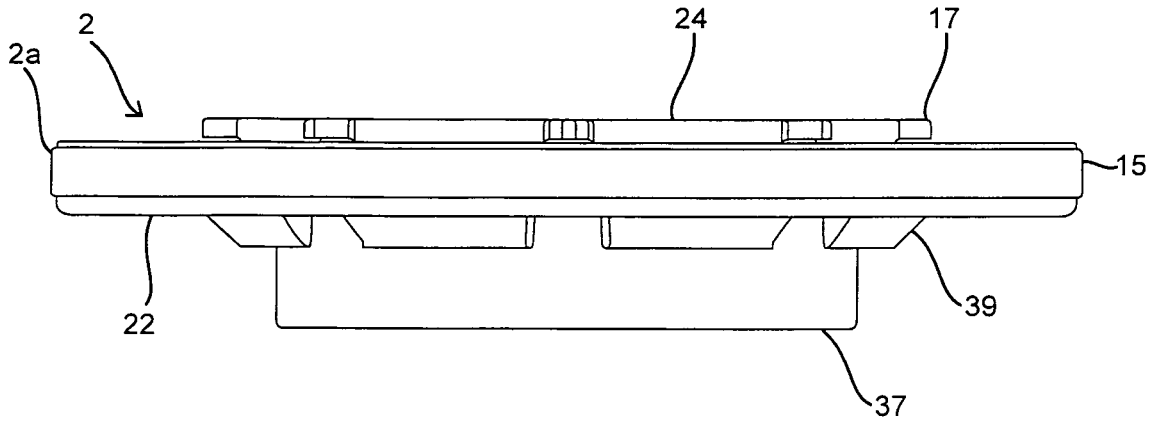
FIG. 17A shows a side view of an alternate embodiment of the first end attachment shown in FIG. 10A.

Alternate embodiments of the present invention are shown in the following FIGS. 17A-19. FIG. 17A shows a side view of an alternate embodiment of the first end attachment 2 that contacts the opening 8 in the tube 1 at the tube's first end 1*a*. The first end attachment in this embodiment shows a modification of the protruding rim on the second side of the first end attachment that was shown in FIG. 10A. In this embodiment, a centrally located cylindrical projection 37 extends from the protruding rim 24 on the second side 22 of second end attachment 2. The positioning of the cylindrical projection 37 and its diameter is such that the projection 37 inserts into the respective opening 8 of the tube 1 when the first end attachment 2 is secured to the first end 1*a* of the tube 1. The projection 37 is also designed to lie flush against the inner wall of the tube when it is inserted into the tube's opening. Further, the space 38 (seen in FIG. 17B) between the cylindrical projection and the plurality of retaining members 39 is adapted to receive the respective end of the tube to allow the respective tube end to nestle therebetween. The plurality of male protrusions 17 are visible on the first side 18 of the first end attachment as extending substantially perpendicular from the protruding rim 24.

The projection 37, combined with the plurality of retaining members 39, provides stability to the fit between the first end attachment 2 and the first end 1*a* of the tube 1. The first end attachment, in this embodiment, may be secured to the first end of the tube by the means that have been discussed herein, which may include screws and/or a strong adhesive. The screws and/or strong adhesive may be inserted between the projection and the inner wall of the tube that lines the opening of the tube. Further, the screws may be inserted between any other surface of the first end attachment and the tube, in addition to or rather than the projection, such as the one or more of the plurality of retaining members. Even further shown in FIG. 17A is the rubber gripping surface 15 that coats at least a portion of the first end attachment's sidewall.

Figure 17B:
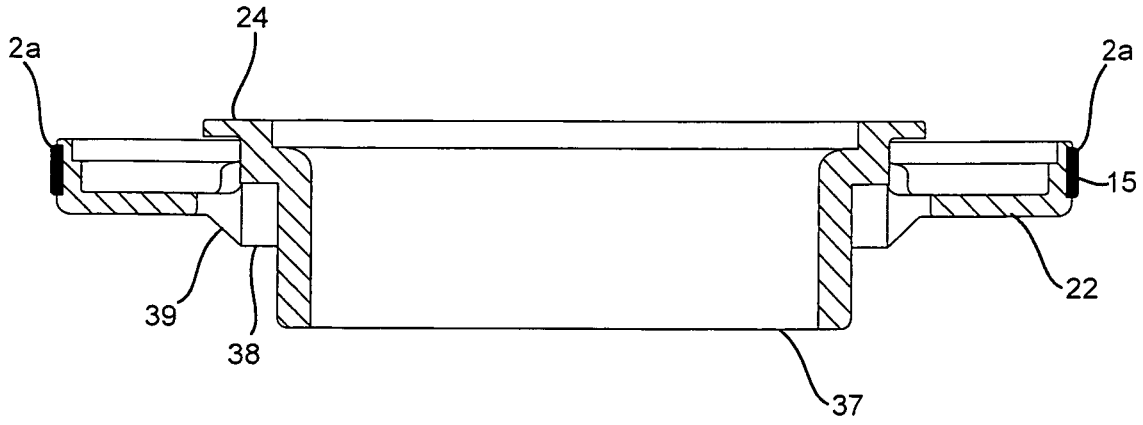
FIG. 17B shows a vertically sliced cross sectional view of the first end attachment of FIG. 17A.

FIG. 17B shows a vertically sliced cross sectional view of the first end attachment of FIG. 17A. Here, the space 38 is seen that receives the respective end of the tube.

Figure 18A:
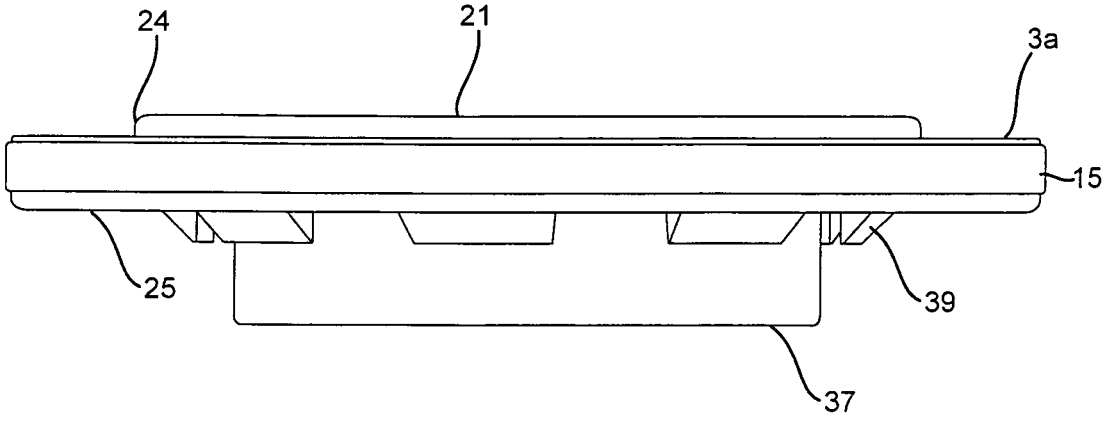
FIG. 18A shows a side view of an alternate embodiment of the second end attachment shown in FIG. 10B.

FIG. 18A shows side view of an alternate embodiment of the second end attachment 3 that contacts the opening 8 in the tube 1 at the tube's second end 1*b*. The cylindrical projection 37, as with respect to the first end attachment 2 of FIG. 17A, is also present as extending from the second side 25 of the second end attachment 3. The structure of the second end attachment in this embodiment is the same as the first end attachment in FIGS. 17A-17B except that the first side 21 of the second end attachment contains a plurality of female receptacles 7 and corresponding tunnel portions 7*a* that are located in the protruding rim 24. This embodiment of the second end attachment 3 may be secured to the second end 1*b* of tube 1 by the same means that were described with respect to FIG. 17A.

Figure 18B:
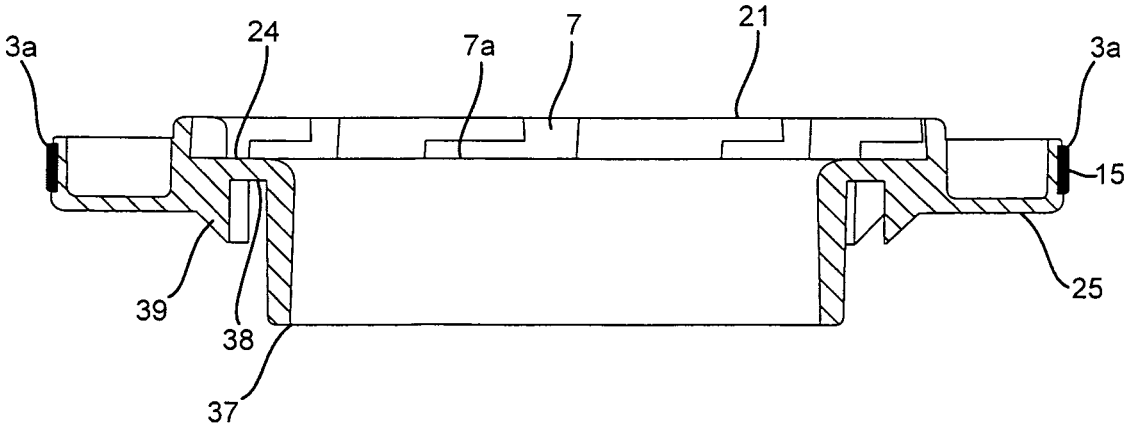
FIG. 18B shows a vertically sliced cross sectional view of the second end attachment of FIG. 18A.

FIG. 18B shows a cross sectional view of the second end attachment of FIG. 18A. Here the space 38 is seen that receives the respective end of the tube.

All of the embodiments of the end attachments as described herein may, on the second side surface 39, have instructions thereon that direct a user as to the direction to rotate the end attachments or handle assemblies to lock or unlock and remove the handle assemblies from the end attachments. These instructions may also be on the surface of the first side of the respective handle assemblies' handle support structure.

Figure 19:
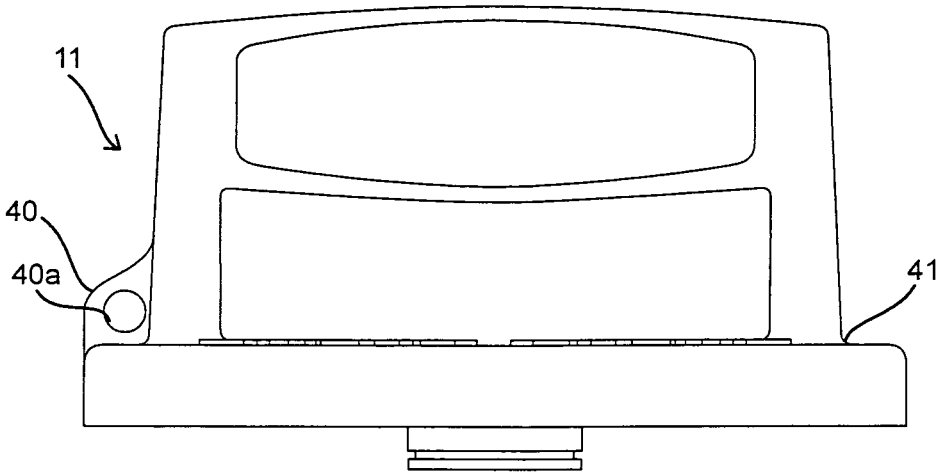
FIG. 19 shows a side view of an alternate embodiment of the handle support structure.

FIG. 19 shows a view of an alternate embodiment of the handle support structure that may be used in conjunction with the first and second handle assemblies of the present invention. The handle support structure 10, in this embodiment, further includes a member 40 for receiving a clip. The member is preferably molded into the handle support structure such that it is situated along the side of one of the handle support columns 11 near the bottom of the handle support column. In this way, the clip receiving member 40 is also in communication with a portion of the first side surface 41 of the handle support structure. The clip receiving member 40 includes an orifice 40*a* for receiving a clip. The clip receiving member is preferably secured to the handle support structure of the first and second handle assemblies to attach to clips of a carrying strap. The carrying strap can be any of a variety of straps used in the art, such as but not limited to a shoulder strap, to allow a user to conveniently carry the exercise device.

The male and female counterparts used in the present invention are the same for all of the components that are connected using male protrusions and female receptacles herein. In particular, in every such connection herein there is a male protrusion that fits into a female receptacle and that is then rotated to be moved into a tunnel portion that is adjacent the female receptacle. In other embodiments, however, the connection mechanisms may be different as long as the first and second handle assembly can be removed from the first and second end of the elongate member and then be mutually joined in a configuration that does not include the elongate member.

What is claimed is:

1. An exercise device that allows a user to perform a variety of exercises comprising:

an elongate member having a first end and a second end;

a first handle assembly attached to said first end of said elongate member, said first handle assembly comprising a base that is rotatably secured to a handle support structure, said handle support structure having at least a pair of handle support columns extending from said handle support structure to an upper end thereof wherein a handle for gripping by a user extends between said upper end of said handle support columns; and a second handle assembly attached to said second end of said elongate member, said second handle assembly comprising a base that is rotatably secured to a handle support structure, said handle support structure having at least a pair of handle support columns extending horn said handle support structure to an upper end thereof wherein a handle for gripping by a user extends between said upper end of said handle support columns, wherein said first handle assembly and said second handle assembly are removable from said first end and said second end of said elongate member and wherein said base of said first handle assembly and said base of said second handle assembly can be mutually joined to form a configuration of the exercise device that does not include said elongate member, said handle support structure of said first and second handle assemblies each including an orifice for receiving a clip that is attached to a strap.

2. The exercise device according to claim 1 wherein said handles of said in handle assembly and said second handle assembly are adapted to be gripped by a user and to receive a force applied by said user to said handles to force said base of each of said handle assemblies to rotate while said gripped handles remain in a substantially fixed position.

3. The exercise device according to claim 1 further comprising a first end attachment at said first end of said elongate member, wherein said first handle assembly attaches to said first end of said elongate member by attaching to said first end attachment.

4. The exercise device according to claim 3 further comprising a second end attachment at said second end of said elongate member, wherein said second handle assembly attaches to said second end of said elongate member by attaching to said second end attachment.

5. The exercise device according to claim 4 wherein a plurality of protrusions on a first side of said first end attachment mate with a plurality of receptacles on a first side of said base said first handle assembly to secure said first handle assembly to said first end attachment.

6. The exercise device according to claim 5 wherein a plurality of receptacles on a first side of said second end attachment mate with a plurality of protrusions on a first side of said base of said second handle assembly to secure said second handle assembly to said second end attachment.

7. The exercise device according to claim 6 wherein said base of said first and second handle assembly has a larger diameter than said handle support structure of said first and second handle assembly, said base of said first and second handle assembly further comprising at least one edge that has at least one sidewall extending therefrom, said handle support structure also comprising at least one edge that has at least one sidewall extending therefrom, said at least one sidewall of said base of said first and said second handle assembly extending over at least a portion of said at least one sidewall of said handle support structure of said first and said second handle assembly when said base is rotatably secured to said handle support structure of each of said handle assemblies, wherein the exterior surface of said at least one sidewall of said bases contacts and grips the surface that said exercise device is rolled along.

8. The exercise device according to claim 7 wherein is rubber gripping surface coats at least a portion of said exterior surface of said at least one sidewall of said base of said first and second handle assemblies.

9. The exercise device according to claim 6 wherein said configuration of said exercise device that does not include said elongate member is formed by detaching said first handle assembly from said first end attachment and said second handle assembly from said second end attachment, and further mating said plurality of receptacles on said first side of said base of said first handle assembly with said plurality of protrusions on said first side of said base of said second handle assembly.

10. The exercise device according to claim 1 wherein said base of said first handle assembly is rotatably secured to said handle support structure of said first handle assembly by a bearing assembly.

11. The exercise device according to claim 1 wherein said base of said second handle assembly is rotatably secured to said handle support structure of said second handle assembly by a bearing assembly.

12. The exercise device according to claim 1 wherein at least a portion of the outside surface of said elongate member is coated with EVA foam.

13. The exercise device according to claim 1 wherein said exercised device is made from a high impact thermoplastic blend.

14. The exercise device according to claim 13 wherein said high impact thermoplastic blend is Cycoloy.RTM. polycarbornate/acrylonitrile-butadiene-styrene (PC/ABS).

15. The exercise device according to claim 1 wherein said elongate member has a hollow core that has an opening at said first and said second end of said elongate member to allow access to said hollow core.

16. The exercise device according to claim 14 wherein said hollow core is configured to contain training and personal items.

17. The exercise device according to claim 15 wherein the interior surface of said elongate member surrounds said hollow core of said elongate member, said interior surface of said elongate member having a weighted item secured along at least a portion of its surface to increase the difficulty level of the exercises that are performed with said exercise device.

18. The exercise device according to claim 1 wherein said handles of said first and second handle assembly include a gripping aid over at least a portion of said handles and wherein said gripping aid is a foam material surrounding said handles.

* * * * *